US012276088B2

(12) United States Patent
Henry et al.

(10) Patent No.: US 12,276,088 B2
(45) Date of Patent: Apr. 15, 2025

(54) AGRICULTURAL SYSTEM AND METHOD FOR DETECTING FAILURE OF A GROUND-ENGAGING TOOL OF AN AGRICULTURAL IMPLEMENT

(71) Applicants: CNH Industrial Canada, Ltd., Saskatoon (CA); CNH Industrial America LLC, New Holland, PA (US)

(72) Inventors: James W. Henry, Saskatoon (CA); Brittany Schroeder, Bunker Hill, IN (US)

(73) Assignees: CNH Industrial Canada, Ltd., Saskatoon (CA); CNH Industrial America LLC, New Holland, PA (US)

( * ) Notice: Subject to any disclaimer, the term of this patent is extended or adjusted under 35 U.S.C. 154(b) by 0 days.

(21) Appl. No.: 18/119,670

(22) Filed: Mar. 9, 2023

(65) Prior Publication Data

US 2024/0301665 A1 Sep. 12, 2024

(51) Int. Cl.

| | |
|---|---|
| ***G05B 23/00*** | (2006.01) |
| ***E02F 9/26*** | (2006.01) |
| ***E02F 9/28*** | (2006.01) |

(52) U.S. Cl.

CPC ..... *E02F 9/267* (2013.01); *E02F 9/261* (2013.01); *E02F 9/2808* (2013.01)

(58) Field of Classification Search

USPC ..... 340/679, 680–683, 684, 687, 686.2, 340/686.6, 691.6, 693.3, 3.43, 825.23, 340/825.49

See application file for complete search history.

(56) References Cited

U.S. PATENT DOCUMENTS

| | | | |
|---|---|---|---|
| 8,827,001 | B2 | 9/2014 | Wendte et al. |
| 9,243,381 | B2 | 1/2016 | Behmlander et al. |
| 9,532,499 | B2 | 1/2017 | Anderson et al. |
| 9,670,649 | B2 | 6/2017 | Bewley et al. |
| 9,714,923 | B2 | 7/2017 | Behmlander et al. |
| 9,883,626 | B2 | 2/2018 | Heim et al. |
| 10,011,975 | B2 | 7/2018 | Carpenter et al. |
| 10,024,003 | B2 | 7/2018 | Wock et al. |
| 10,151,830 | B2 | 12/2018 | Cook et al. |
| 10,820,476 | B2 | 11/2020 | Stoller et al. |
| 10,827,665 | B2 | 11/2020 | Sporrer et al. |
| 11,197,408 | B2 | 12/2021 | Ferrari |
| 11,259,454 | B2 | 3/2022 | Kovach et al. |
| 11,470,763 | B2 | 10/2022 | Barrick et al. |

(Continued)

*Primary Examiner* — Daniel Previl

(74) *Attorney, Agent, or Firm* — Dority & Manning, P.A.

(57) ABSTRACT

An agricultural system for detecting failure of a ground-engaging tool of an agricultural implement includes a ground-engaging tool supported on an agricultural implement, with the ground-engaging tool being configured to engage a field during an agricultural operation of the agricultural implement within the field. The system further includes a field profile sensor configured to generate data indicative of a profile of an aft portion of the field located rearward of the ground-engaging tool relative to a direction of travel of the agricultural implement. Additionally, the system includes a computing system configured to monitor the profile of the aft portion of the field during the agricultural operation based at least in part on the data generated by the field profile sensor and determine that the ground-engaging tool failed based at least in part on the profile of the field.

20 Claims, 8 Drawing Sheets

(56) References Cited

U.S. PATENT DOCUMENTS

| | | | | |
|---|---|---|---|---|
| 2005/0172733 | A1* | 8/2005 | Drummond | A01B 79/005 73/864.41 |
| 2008/0053669 | A1* | 3/2008 | Hou | A01B 63/112 172/3 |
| 2017/0196160 | A1* | 7/2017 | Bjerketvedt | A01B 15/02 |
| 2018/0279542 | A1* | 10/2018 | Kovach | A01B 63/28 |
| 2020/0114843 | A1* | 4/2020 | Foster | G07C 5/0825 |
| 2020/0226851 | A1* | 7/2020 | Harmon | G07C 5/006 |
| 2020/0337208 | A1 | 10/2020 | Hertzog et al. | |
| 2021/0084804 | A1* | 3/2021 | Stanhope | A01B 63/1112 |
| 2021/0102856 | A1* | 4/2021 | Glovier | A01B 61/042 |
| 2021/0105928 | A1 | 4/2021 | Henry | |
| 2021/0105931 | A1 | 4/2021 | Anderson, Jr. et al. | |
| 2021/0134090 | A1 | 5/2021 | Sporrer et al. | |
| 2021/0190754 | A1 | 6/2021 | Stoller et al. | |
| 2021/0243939 | A1 | 8/2021 | Strnad et al. | |
| 2022/0295683 | A1 | 9/2022 | Schroeder | |

* cited by examiner

AGRICULTURAL SYSTEM AND METHOD FOR DETECTING FAILURE OF A GROUND-ENGAGING TOOL OF AN AGRICULTURAL IMPLEMENT

FIELD OF THE INVENTION

The present disclosure relates generally to agricultural implements, and more particularly, to an agricultural system and an associated agricultural method for detecting failure of a ground-engaging tool of an agricultural implement during the performance of an agricultural operation.

BACKGROUND OF THE INVENTION

A wide range of agricultural implements have been developed and are presently in use for tilling, cultivating, harvesting, and so forth. Tillage implements, for example, are commonly towed behind tractors and may cover wide swaths of ground. Tillage implements can include one or more ground-engaging tools configured to engage the soil as the implement is moved across the field. For example, in certain configurations, the implement may include one or more harrow disks, shanks, leveling disks, rolling baskets, tines, and/or the like. Such ground-engaging tools loosen and/or otherwise agitate the soil to prepare the field for subsequent field operations.

When performing a tillage operation, it is desirable to create a level and uniform layer of tilled soil across the field to form a proper seedbed for subsequent planting operations. However, due to poor visibility during operation, it is often very difficult for an operator to determine when one or more of the ground-engaging tools has failed such that it is no longer properly engaging the field and requires operator intervention to be corrected, such as when a shear bolt for a shank has broken, a leveling disk has fallen off, and/or the like. As such, an extensive portion of the field may have been worked before an operator discovers the failed ground-engaging tool(s), which negatively affects subsequent field operations and, ultimately, yields.

Accordingly, an agricultural system and method for detecting failure of a ground-engaging tool of an agricultural implement would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to an agricultural system for detecting failure of a ground-engaging tool of an agricultural implement. The agricultural system may include a ground-engaging tool supported on an agricultural implement, where the ground-engaging tool may be configured to engage a field during an agricultural operation of the agricultural implement within the field. Further, the agricultural system may include a field profile sensor configured to generate data indicative of a profile of an aft portion of the field located rearward of the ground-engaging tool relative to a direction of travel of the agricultural implement. Additionally, the system may include a computing system communicatively coupled to the field profile sensor, with the computing system being configured to monitor the profile of the aft portion of the field during the agricultural operation based at least in part on the data generated by the field profile sensor and determine that the ground-engaging tool failed based at least in part on the profile of the field.

In another aspect, the present subject matter is directed to an agricultural method for detecting failure of a ground-engaging tool of an agricultural implement, where the ground-engaging tool may be supported on the agricultural implement, and where the ground-engaging tool may be configured to engage a field during an agricultural operation of the agricultural implement within the field. The agricultural method may include receiving, with a computing system, data indicative of a profile of an aft portion of the field located rearward of the ground-engaging tool relative to a direction of travel of the agricultural implement, the data being generated by a field profile sensor. Further, the agricultural method may include monitoring, with the computing system, the profile of the aft portion of the field during the agricultural operation based at least in part on the data generated by the field profile sensor. Moreover, the agricultural method may include determining, with the computing system, that the ground-engaging tool failed based at least in part on the profile of the aft portion of the field. Additionally, the method may include performing, with the computing system, a control action in response to determining that the ground-engaging tool failed.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
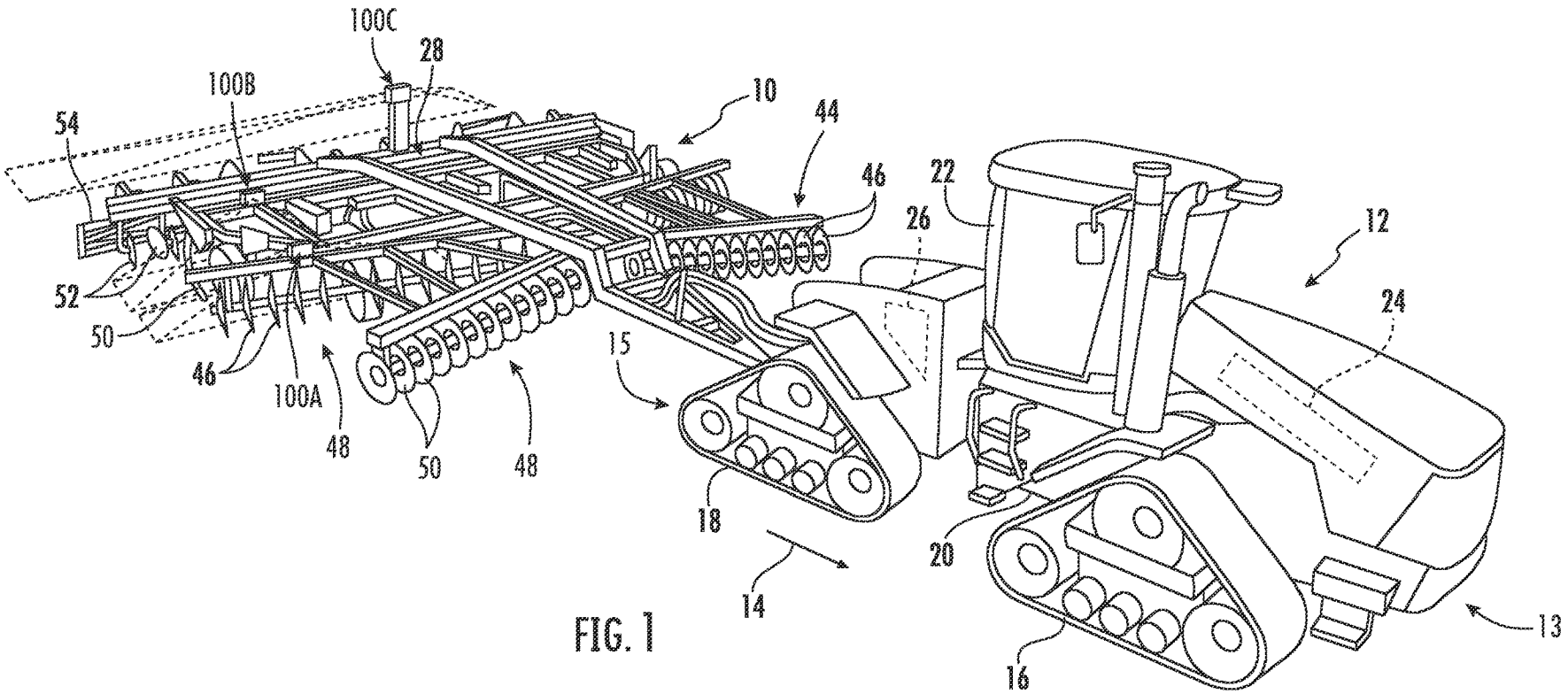
FIG. 1 illustrates a perspective view of one embodiment of an agricultural implement coupled to a work vehicle in accordance with aspects of the present subject matter.

Repeat use of reference characters in the present specification and drawings is intended to represent the same or analogous features or elements of the present technology.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield still a further embodiment. Thus, it is intended that the present invention covers such modifications and variations as come within the scope of the appended claims and their equivalents.

In general, the present subject matter is directed to systems and methods for detecting failure of one or more ground-engaging tools of an agricultural implement. Specifically, in several embodiments, the disclosed system may monitor a profile of the field behind the implement as the implement performs an operation within the field to determine when ground-engaging tools have failed, particularly when shear bolts holding shanks in an engagement position have failed and/or when leveling disks have failed (i.e., are no longer attached). For instance, in accordance with aspects of the present subject matter, a field profile sensor may be provided in association with the implement, with the field profile sensor being configured to generate data indicative of at least one profile (e.g., a surface profile and/or a subsurface profile) of the field rearward of at least a portion of the implement. During normal operation, the shanks should break up the compaction layer beneath the surface of the field, leaving behind a surface profile with a generally v-shaped trench and a mound on either side of the trench, while the leveling disks following the shanks should level the mounds on the sides of the trench, filling in the trench and leaving a relatively smooth surface profile. However, when a shear bolt holding a shank in an operating configuration shears or fails, the shank rotates up out of the ground and cannot re-engage the ground reliably. As such, when the shank (i.e., the shear bolt associated with the shank) fails, any compaction layer in the portion of the field associated with the shank is not broken up and no v-shaped trench is formed. Similarly, when a leveling disk breaks or falls off, the v-shaped trench (if present) created by the associated shank is not closed such that the surface profile retains the v-shaped trench, and optionally one or both of the mounds surrounding the trench.

Accordingly, a computing system may be configured to monitor the profile of the aft portion of the field based on the data generated by one or more of the field profile sensors, to determine when one or more ground-engaging tools of the implement has failed. In some embodiments, the computing system may further be configured to automatically initiate a control action to mitigate the effects of the failed tool. For instance, in one embodiment, the computing system may slow down or stop the implement and/or may issue a notification to an operator indicating that the ground-engaging tool(s) failed.

Figure 2:
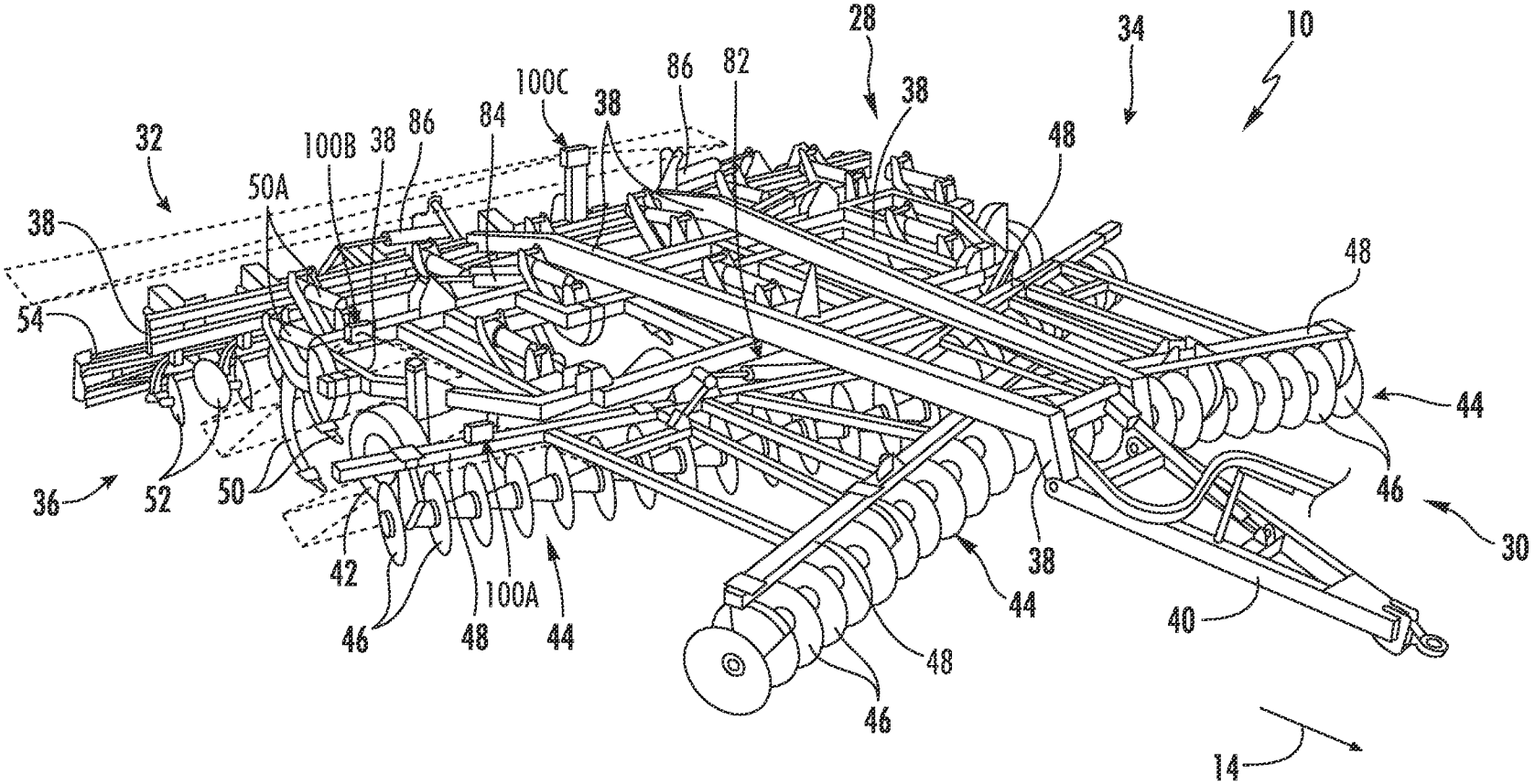
FIG. 2 illustrates another perspective view of the agricultural implement shown in FIG. 1 in accordance with aspects of the present subject matter, particularly illustrating various components of the implement.

Referring now to the drawings, FIGS. 1 and 2 illustrate differing perspective views of one embodiment of an agricultural implement 10 in accordance with aspects of the present subject matter. Specifically, FIG. 1 illustrates a perspective view of the agricultural implement 10 coupled to a work vehicle 12. Additionally, FIG. 2 illustrates a perspective view of the implement 10, particularly illustrating various components of the implement 10.

In general, the implement 10 may be configured to be towed across a field in a direction of travel (e.g., as indicated by arrow 14 in FIG. 1) by the work vehicle 12. As shown, the implement 10 may be configured as a tillage implement, and the work vehicle 12 may be configured as an agricultural tractor. However, in other embodiments, the implement 10 may be configured as any other suitable type of implement, such as a seed-planting implement, a fertilizer-dispensing implement, and/or the like. Similarly, the work vehicle 12 may be configured as any other suitable type of vehicle, such as an agricultural harvester, a self-propelled sprayer, and/or the like.

As shown in FIG. 1, the work vehicle 12 may include a pair of front track assemblies 16, a pair of rear track assemblies 18, and a frame or chassis 20 coupled to and supported by the track assemblies 16, 18. An operator's cab 22 may be supported by a portion of the chassis 20 and may house various input devices for permitting an operator to control the operation of one or more components of the work vehicle 12 and/or one or more components of the implement 10. Additionally, as is generally understood, the work vehicle 12 may include an engine 24 and a transmission 26 mounted on the chassis 20. The transmission 26 may be operably coupled to the engine 24 and may provide variably adjusted gear ratios for transferring engine power to the track assemblies 16, 18 via a drive axle assembly (not shown) (or via axles if multiple drive axles are employed).

As shown particularly in FIG. 2, the implement 10 may include a frame 28. More specifically, the frame 28 may extend longitudinally between a forward end 30 and an aft end 32. The frame 28 may also extend laterally between a first side 34 and a second side 36. In this respect, the frame 28 generally includes a plurality of structural frame members 38, such as beams, bars, and/or the like, configured to support or couple to a plurality of components. Furthermore, a hitch assembly 40 may be connected to the frame 28 and configured to couple the implement 10 to the work vehicle 12. Additionally, a plurality of wheels 42 (one of which is shown in FIG. 2) may be coupled to the frame 28 to facilitate towing the implement 10 in the direction of travel 14.

In several embodiments, one or more ground-engaging tools may be coupled to and/or supported by the frame 28. More particularly, in certain embodiments, the ground-engaging tools may include one or more disk blades 46 and/or one or more shanks 50 supported relative to the frame 28. In one embodiment, each disk blade 46 and/or shank 50 may be individually supported relative to the frame 28. Alternatively, one or more groups or sections of the ground-engaging tools may be ganged together to form one or more ganged tool assemblies. For instance, the disk blades 46 may be ganged together to form one or more disk gang assemblies 44 as shown in FIGS. 1 and 2. More particularly, as illustrated in FIG. 2, each disk gang assembly 44 includes a toolbar 48 coupled to the implement frame 28 and a plurality of disk blades 46 supported by the toolbar 48 relative to the implement frame 28. Each disk blade 46 may, in turn, be configured to penetrate into or otherwise engage the soil as the implement 10 is being pulled through the field. As is generally understood, the various disk gang assemblies 44 may be oriented at an angle relative to the direction of travel 14 to promote more effective tilling of the soil. Further, the implement 10 may include one or more sets of the ground-engaging tools along the longitudinal direction. For example, the implement 10 shown in FIGS. 1 and 2 includes two sets of shanks 50 spaced apart along the longitudinal direction, where at least some of the forward set of shanks 50 is also laterally offset from the rearward set of shanks 50, such that the offset shanks of the forward set of shanks 50 work different lateral sections of the field from the shanks of the rearward set of shanks 50.

Figure 3:
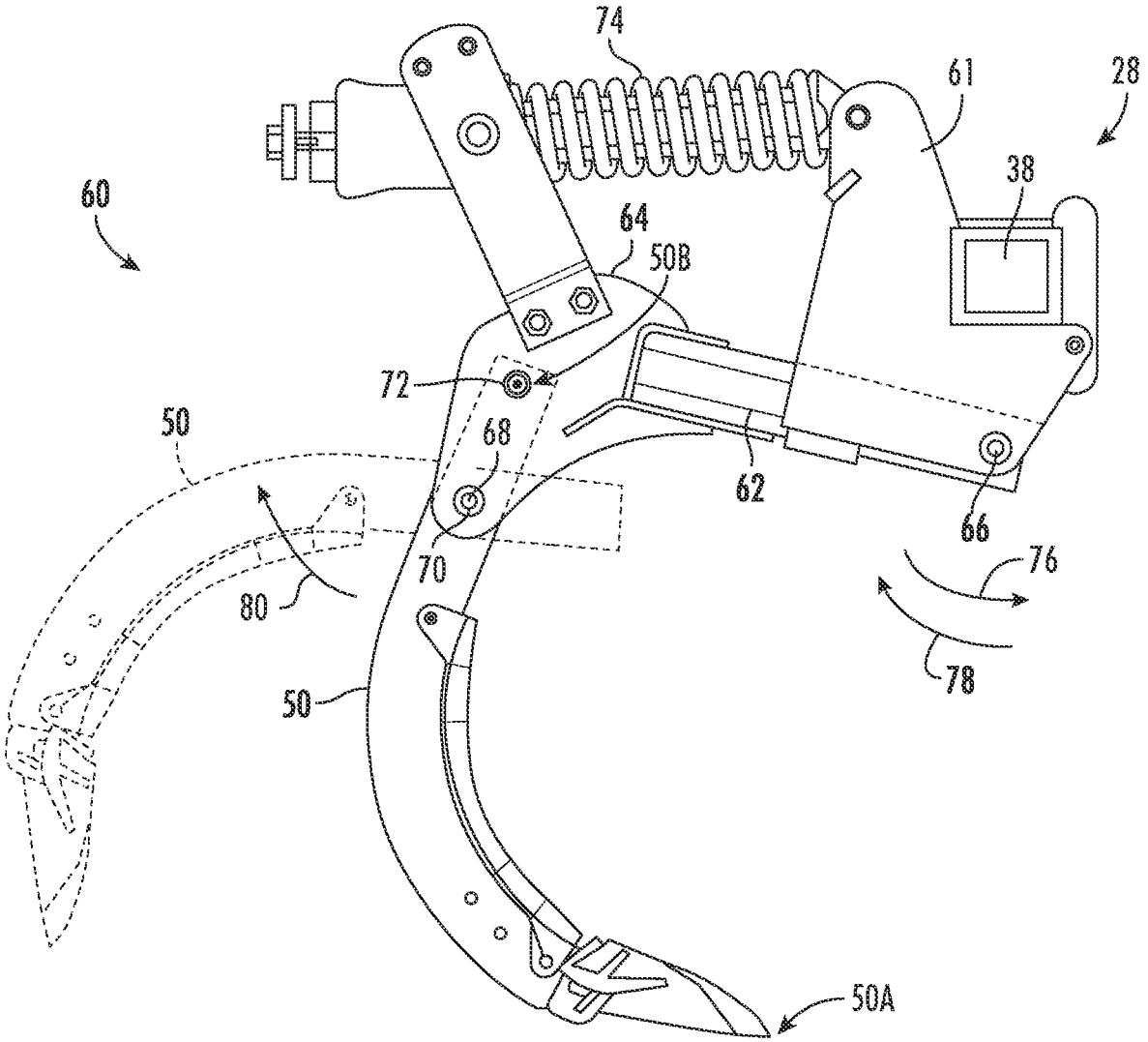
FIG. 3 illustrates a side view of one embodiment of a shank assembly including a shank pivotably coupled to an implement frame in accordance with aspects of the present subject matter.

In FIG. 3, a side-view of a shank assembly including one of the shanks 50 of the tillage implement 10 described above with reference to FIGS. 1 and 2 is illustrated in accordance with aspects of the present subject matter. As shown in the illustrated embodiment, the shank assembly includes the shank 50 and an associated attachment structure 60 for pivotably coupling the shank 50 to the implement frame 28 (e.g., about a first pivot point 66). More particularly, the attachment structure 60 includes a first attachment member 61, a second attachment member 62, and a third attachment member 64. The first attachment member 61 is fixed to the implement frame 28 (e.g., to frame member 38). A first end of the second attachment member 62 is pivotably coupled to the first attachment member 61 at the first pivot joint 66. The third attachment member 64 is fixed to a second end of the second attachment member 62.

The shank 50 extends between a proximal or tip end 50A and a distal end 50B, with the shank 50 being pivotably coupled to the attachment structure 60 (e.g., to the third attachment member 64) of the shank assembly at a second pivot point 68 proximate the distal end 50B. For instance, the shank 50 may be coupled to the third attachment member 64 via an associated pivot member 70 (e.g., a support pivot bolt or pin, hereinafter referred to as "the support pin 70") extending through both the shank 50 and the attachment member 64 at the second pivot point 68. As such, the shank 50 may pivot about the second pivot point 68 relative to the frame 28 independent of the pivoting about the first pivot point 66.

Further, as shown in FIG. 3, the shank assembly may include a shear bolt or pin 72 (hereinafter referred to as "the shear pin 72") for preventing pivoting of the shank 50 about the second pivot point 68 during normal operation of the tillage implement. For instance, the shear pin 72 at least partially extends through both the attachment structure 60 (e.g., through third attachment member 64) and the shank 50 at a location spaced apart from the second pivot point 68. For example, in the illustrated embodiment, the shear pin 72 is received within openings formed above the second pivot point 68 in the attachment member 64 and the shank 50. However, the shear pin 72 may be positioned at any other suitable location relative to the second pivot point 68. In one embodiment, the shear pin 72 may correspond to a mechanical pin designed such that the pin breaks when a predetermined force is applied through the pin or a certain amount of fatigue of the pin has occurred. For instance, the shear pin 72 may be designed to withstand normal or expected loading conditions for the shank 50 and fail when the loads applied through the shear pin 72 exceed or substantially exceed such normal/expected loading conditions or when the fatigue life of the shear pin 72 is reached. Particularly, the shear pin 72 may be configured to fail before other components of the shank assembly. More particularly, the shear pin 72 is configured to fail before the support pin 70 and the shank 50. As such, the shear pin 72 has a lower fatigue life threshold (e.g., a shorter fatigue life) than a fatigue life threshold of the support pin 70 and a fatigue life threshold of the shank 50. Accordingly, the shear pin 72 may break to protect at least the support pin 70 and/or the shank 50 from damage or failure.

Additionally, in several embodiments, the shank assembly may include a biasing element 74 for biasing the shank 50 towards a ground-engaging tool position relative to the frame 28. In general, the shank 50 is configured to penetrate the soil to a desired depth when the shank 50 is in the ground-engaging tool position. In operation, the biasing element 74 may permit relative movement between the shank 50 and the frame 28. For example, the biasing element 74 may be configured to bias the shank 50 (and the attachment structure 60) to pivot relative to the frame 28 in a first pivot direction (e.g., as indicated by arrow 76). The biasing element 74 also allows the shank 50 (and the attachment structure 60) to pivot away from the ground-engaging tool position (e.g., to a shallower depth of penetration), such as in a second pivot direction (e.g., as indicated by arrow 78 in FIG. 3) opposite the first pivot direction 76, when encountering rocks or other impediments in the field. In the embodiment shown, the biasing element 74 is configured as a spring. It should be recognized, however, that the biasing element 74 may be configured as an actuator or any other suitable biasing element.

During normal operation, the tip end 50A of the shank 50 may encounter impediments in the field causing the shank assembly to rotate about the first pivot point 66 in the second pivot direction 78. Typically, the shank 50 will pivot upwards in the second pivot direction 78 about the first pivot point 66 to clear the impediment and then will return to its home or ground-engaging position via the action of the biasing element 74. However, in certain instances, a larger amount of force than typical may be transmitted through the shank assembly and/or the shear pin 72 may reach its fatigue limit. In such instances the shear pin 72 may be designed to fracture or fail, thereby allowing the shank 50 to rotate about the second pivot point 68 relative to the attachment member 64. For instance, the shank 50 may rotate about the second pivot point 68 (as indicated by arrow 80 in FIG. 3) to the shank position indicated by dashed lines in FIG. 3. As such, when the shear pin 72 has failed, the shank 50 can no longer perform the tillage operation. As indicated above, the longer an operator continues to perform the tillage operation with the broken shear pin 72, the worse the overall quality of the tillage operation.

Referring back to FIGS. 1 and 2, it should be appreciated that, in addition to the disk blades 46 and the shanks 50, the implement frame 28 may be configured to support any other suitable ground-engaging tools. For instance, in the illustrated embodiment, the frame 28 is also configured to support a plurality of leveling blades or disks 52 and rolling (or crumbler) basket assemblies 54. In other embodiments, any other suitable ground-engaging tools may be coupled to and supported by the implement frame 28. The leveling disks 52 are positioned generally aft of the shanks 50, and the basket assemblies 54 are generally positioned aft of the leveling disks 52. In some instances, the spacing of the leveling disks 52 is different from the spacing of the shanks 50. For instance, the leveling disks 52 may be laterally spaced apart from each other by about seven to about ten inches, whereas the shanks 50 may be laterally spaced apart from each other by about twenty to about thirty inches. During normal operation, the leveling disks 52 are configured to smooth out the trenches in the field created by the shanks 50. However, if one or more of the leveling disks 52 falls off, one or more of the trenches closest to the missing leveling disks 52 remains open.

As indicated above, it can be difficult for an operator to determine when the ground engaging tool(s), such as the shank(s) 50 and the leveling disk(s) 52, fail, which negatively affects subsequent field operations and, ultimately, yields. Thus, in accordance with aspects of the present subject matter one or more field profile sensors are provided for monitoring a profile of an aft portion of the field located aft or rearward of one or more of the ground-engaging tools of the implement 10. For instance, in some embodiments, one or more first sensors 100A are provided, where each of the first sensor(s) 100A has a field of view directed aft of the disk blades 46 and is configured to generate data indicative of a profile of the portion of field within the field of view, after the disk blades 46 have worked the portion of the field and before the shanks 50 have worked the portion of the field. Similarly, in some embodiments, one or more second sensors 100B are provided, where each of the second sensor(s) 100B has a field of view directed aft of the shanks 50 and is configured to generate data indicative of a profile of the portion of the field within the field of view after the shanks 50 have worked the portion of the field and before the leveling disks 52 have worked the portion of the field. Additionally, or alternatively, in some embodiments, one or more third sensors 100C are provided, where each of the third sensor(s) 100C has a field of view directed aft of the leveling disks 52 and/or basket assemblies 54 and is configured to generate data indicative of a profile of the portion of the field after the leveling disks 52 and/or basket assemblies 54 have worked the portion of the field (e.g., after the implement 10 has completed working the portion of the field).

As will be described in greater detail below, in some embodiments, the field profile sensor(s) 100A, 100B, 100C may be configured to generate data indicative of a surface profile of a surface of the aft portion(s) of the field and/or a sub-surface profile of a sub-surface of the aft portion(s) of the field. For instance, the surface profile may include a shape, a dimension, and/or the like of the surface of the aft portion(s) of the field. The sub-surface profile may indicate a profile of a compaction layer and/or the like beneath a surface of the aft portion(s) of the field. In this regard, the field profile sensor(s) 100A, 100B, 100C may include one or more cameras (including stereo camera(s), and/or the like), LIDAR sensors (e.g., single and/or multiple frequency LIDAR sensors), radar sensors, ultrasonic sensors (e.g., 2D and/or 3D ultrasonic sensors), electromagnetic induction (EMI) sensors, and/or the like, that allows the sensor(s) 100A, 100B, 100C to generate image data, point-cloud data, radar data, ultrasound data, EMI data, and/or the like indicative of the surface profile of the aft portion(s) of the field, one or more ground-penetrating radar (GPR) sensors and/or the like that allows the sensor(s) 100A, 100B, 100C to generate GPR data indicative of the sub-surface profile of the aft portion(s) of the field, and/or any suitable combination of such sensor(s).

It should be appreciated that the sensor(s) 100A, 100B, 100C may be positioned at any suitable location relative to the implement 10 to generate data indicative of the profile(s) of the aft portion(s) of the field. For example, in some instances, the sensor(s) 100A, 100B, 100C are positioned on the implement 10, such as on the frame 28. However, in some instances, the sensor(s) 100A, 100B, 100C are additionally, or alternatively, positioned remote from the implement 10, such as on an unmanned aerial vehicle (UAV), on the vehicle 12 towing the implement 10, and/or the like. It should additionally be appreciated that, in some instances, multiples of the sensor(s) 100A, 100B, 100C are provided and spaced apart along the lateral direction L1 so that the profile(s) of an entire swath worked by the implement 10 may be monitored at a given instance.

It should be appreciated that the configuration of the implement 10 described above and shown in FIGS. 1 and 2 is provided only to place the present subject matter in an exemplary field of use. Thus, it should be appreciated that the present subject matter may be readily adaptable to any manner of implement configuration.

Figure 4:
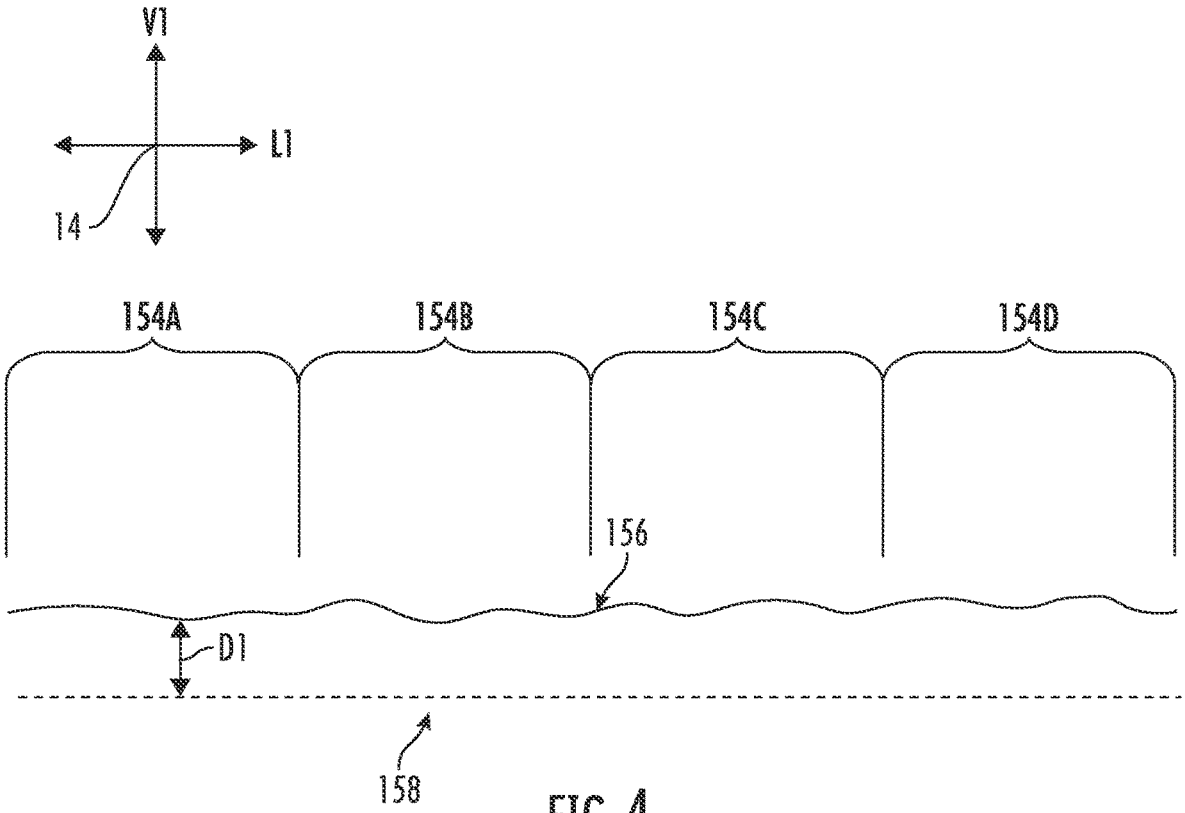
FIG. 4 illustrates a partial section view of a field in accordance with aspects of the present subject matter, particularly illustrating exemplary profiles of the field detectable directly prior to being worked by shank assemblies of the implement.
Figure 5:
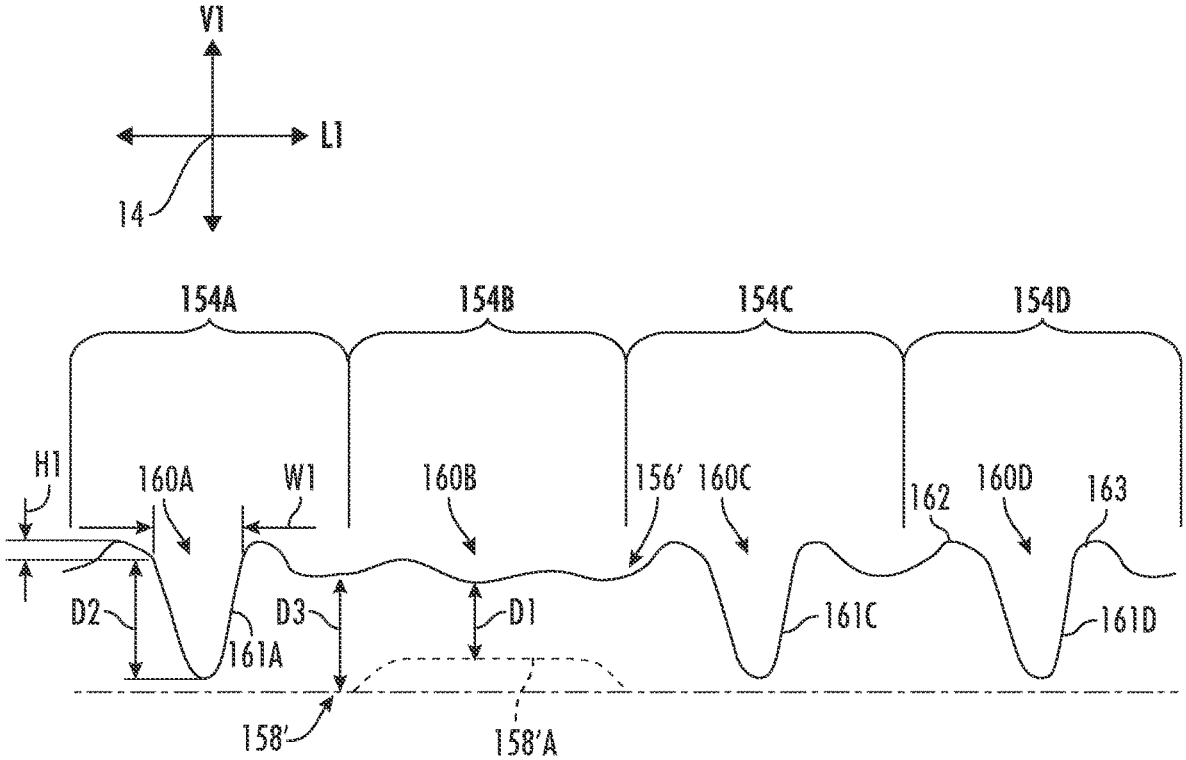
FIG. 5 illustrates another partial section view of a field in accordance with aspects of the present subject matter, particularly illustrating exemplary profiles of the field detectable directly after being worked by shank assemblies.
Figure 6:
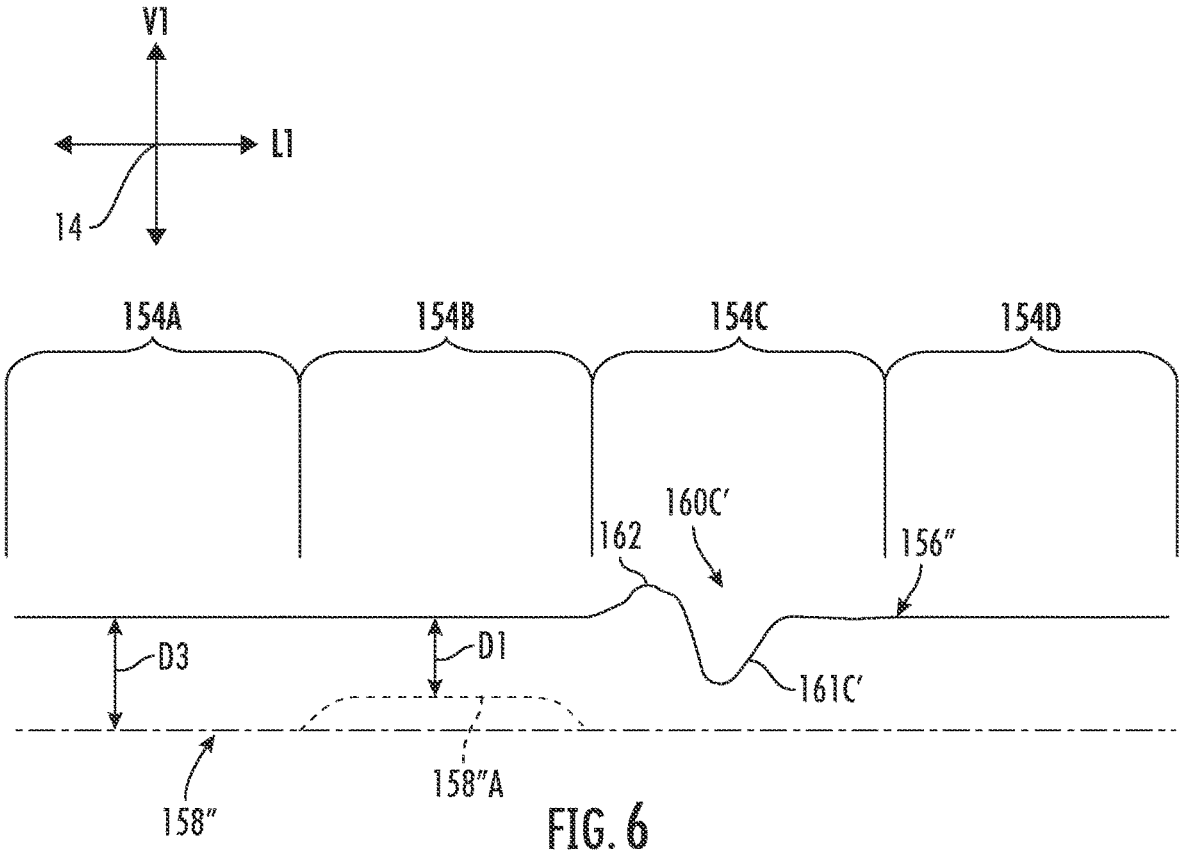
FIG. 6 illustrates a further partial section view of a field in accordance with aspects of the present subject matter, particularly illustrating exemplary profiles of the field detectable directly after being worked by the implement.

Referring now to FIGS. 4-6, various partial section views of a field are illustrated in accordance with aspects of the present subject matter, particularly illustrating different profiles indicated by the data generated by the sensor(s) 100A, 100B, 100C. For instance, FIG. 4 particularly illustrates exemplary profiles of the field detectable directly prior to being worked by the shank assemblies 50 of the implement 10. FIG. 5 illustrates exemplary profiles of the field detectable directly after being worked by the shank assemblies 50, and before being worked by leveling disks 52 of the implement 10. Additionally, FIG. 6 illustrates exemplary profiles of the field detectable directly after being worked by the implement 10.

As can be appreciated from FIGS. 4-6, the aft portion(s) of the field located rearward of various tools of the implement 10 may be divided along the lateral direction L1 into lateral portions or "lanes", such as a first lane 154A, a second lane 154B, a third lane 154C, a fourth lane 154D, and so on. Each lane is associated with a respective one of the shanks 50. Specifically, each lane is aligned along the direction of travel 14 with and worked by the respective shank assembly 100. For instance, the first lane 154A is associated with and worked by a first one of the shanks 50, the second lane 154B is associated with and worked by a second one of the shanks 50, the third lane 154C is associated with and worked by a third one of the shanks 50, and the fourth lane 154D is associated with and worked by a fourth one of the shanks 50. The sensor(s) 100A, 100B, 100C are configured to generate data indicative of the profile within one or more of the lanes 154A, 154B, 154C, 154D.

In FIG. 4, an example first surface profile 156 and an example first sub-surface profile 158 of the portion of the field aft of the disk gangs 44, and before the shanks 50, produced by data generated by the first sensor(s) 100A are shown. Particularly, the first surface profile 156 is substantially level across the different lanes 154A, 154B, 154C, 154D, without any significant changes between the lanes 154A, 154B, 154C, 154D. The first sub-surface profile 158 is positioned an average distance D1 beneath the surface profile 156 in the vertical direction V1. The first sub-surface profile 158 is also substantially level across the lanes 154A, 154B, 154C, 154D, without any prominent changes between the lanes 154A, 154B, 154C, 154D. It should be appreciated that, as used herein, the first sub-surface profile 158 generally represents a compaction layer below where disk gang assemblies 44 typically operate. As the first surface and sub-surface profiles 156, 158 are generally level, it is assumed that the disk gang assemblies 44 are operating correctly. Thus, the first surface and sub-surface profiles 156, 158 may be used as reference profiles for monitoring the performance of subsequent ground-engaging tools, such as the shanks 50 and leveling disks 52, as will be described in greater detail below.

In FIG. 5, an example second surface profile 156' and an example second sub-surface profile 158' of the portion of the field aft of the shanks 50, and before the leveling disks 52, produced by data generated by the second sensor(s) 100B are shown. Particularly, the second surface profile 156' includes surface features within each lane 154A, 154B, 154C, 154D that can be correlated to the performance of each associated shank 50. For instance, a first lane surface profile 160A of the first lane 154A, a second lane surface profile 160B in the second lane 154B, a third lane surface profile 160C in the third lane 154C, and a fourth lane surface profile 160D in the fourth lane 154D may be correlated to the performance or status of the respective shank 50. For example, the first, third, and fourth lane surface profile 160A, 160C, 160D within the first, third, and fourth lanes 154A, 154C, 154D, respectively, include generally v-shaped trenches 161A, 161C, 161D having a width W1 and a depth D2, a first mound 162 generated directly adjacent to one lateral side of each trench, and a second mound 163 generated directly adjacent to the other lateral side of each trench, where the mounds 162, 163 each have a height H1 above the trenches 161A, 161C, 161D. The presence of the v-shaped trenches 161A, 161C, 161D and respective pairs of mounds 162, 163 within the lanes 154A, 154C, 154D is generally indicative that the corresponding shanks 50 are properly engaging the field. The second lane surface profile 160B within the second lane 154B, however, does not include a v-shaped trench and associated mounds. Instead, the second lane surface profile 160B is almost the same, or is the same, as seen in the second lane 154B of the first surface profile 156 in FIG. 4. As such, it can be assumed that the shank 50 corresponding to the second lane 154B is not properly engaging the field and thus, could have failed. For instance, if the shear bolt of the shank 50 corresponding to the second lane 154B has broken, the shank 50 may be barely engaging the field or completely raised out of engagement with the field.

The second sub-surface profile 158' also indicates that the shanks 50 associated with the first, third and fourth lanes 154A, 154C, 154D are properly engaging the field and that the shank 50 corresponding to the second lane 154B is not properly engaging the field and thus, could have failed. For instance, the second sub-surface profile 158' extends at a depth D3 within the first, third and fourth lanes 154A, 154C, 154D, such that the second sub-surface profile 158' is below the first sub-surface profile 158 from FIG. 4. In some instances, the depth D3 corresponds to the depth D2. However, in other embodiments, the depth D3 is larger than the depth D2, such that the sub-surface profile 158' extends below the trenches generated by the shanks 50, such as the trenches within the lanes 154A, 154C, 154D. Generally, as the second sub-surface profile 158' within the first, third and fourth lanes 154A, 154C, 154D is below the first sub-surface profile 158 from FIG. 4 in the vertical direction V1, it can be assumed that the shanks 50 associated with the first, third and fourth lanes 154A, 154C, 154D are properly engaging the field, breaking up the compaction layer at the depth D1 up to the depth D3. Whereas, the portion 158'A of the second sub-surface profile 158' within the second lane 154B still extends at the depth D1, indicating that the shank 50 associated with the second lane 154B is not properly engaging the field and thus, could have failed. In some instances, hard objects (e.g., rocks and/or the like) that can cause the shank 50 to trip may be identified in the data generated by the sensor(s) 100B (FIGS. 1 and 2). Thus, if no hard object has been identified within the second lane 154B just before or when the shank 50 associated with the second lane 154B is determined to potentially have failed, then it may be assumed that the shank 50 associated with the second lane 154B has likely failed.

As will be described in greater detail below, in some embodiments, once one or more of the shanks 50 is determined to have potentially failed, the potentially failed shank(s) 50 may continue to be monitored. For instance, the data generated by the sensor(s) 100B (FIGS. 1 and 2) may continue to be monitored to see if the shank 50 associated with the second lane 154B begins to engage with the soil and cause an expected trench and associated mounds adjacent the trench. If it is determined that the shank 50 associated with the second lane 154B does not begin to engage with the soil in such a way as to create the expected trench and associated mounds after a given period of time, such as after a few seconds, it can be confirmed that the shank 50 has failed, instead of tripping or floating momentarily.

In FIG. 6, an example third surface profile 156" and an example third sub-surface profile 158" of the portion of the field aft of the leveling disks 52, produced by data generated by the third sensor(s) 100C are shown. Particularly, the third surface profile 156" is substantially smooth across the first, second, and fourth lanes 154A, 154B, 154D, indicating that the leveling disks 52 associated with the first and fourth lanes 154A, 154D have redistributed the mounds 162A, 162B from FIG. 5 adjacent the trenches to fill in the trenches within the first and fourth lanes 154A, 154D shown in FIG. 5, and that the leveling disks 52 associated with the second lane 154B has further smoothed the surface within the second lane 154B compared to the surface within the second lane 154B shown in FIG. 5. As such, it can be assumed that the leveling disks 52 associated with the first, second, and fourth lanes 154A, 154B, 154D are properly engaging the field. Conversely, the lane surface profile 160C' of the third surface profile 156" within the third lane 154C still has a trench 161C' which corresponds to a portion of the v-shaped trench 161C (FIG. 5) and retains the first mound 162, while the second mound 163 shown in FIG. 5 has been substantially or completely smoothed. Accordingly, it can be determined that at least one of the leveling disks 52 associated with the third lane 154C, such as the leveling disk 52 closest aligned with the first mound 162, has failed. For instance, if the leveling disk 52 closest aligned with the first mound 162 has fallen or broken off, the leveling disk 52 is no longer able to engage and redistribute the first mound 162.

The third sub-surface profile 158" confirms the determinations from FIG. 5. Particularly, the third sub-surface profile 158" extends at a depth D3 within the first, third and fourth lanes 154A, 154C, 154D, such that the third sub-surface profile 158" is also below the first sub-surface profile 158 from FIG. 4, whereas, the portion 158"A of the third sub-surface profile 158" within the second lane 154B still extends at the depth D1. As such, it can be assumed that the shanks 50 associated with the first, third and fourth lanes 154A, 154C, 154D are properly engaging the field, while the shank 50 associated with the second lane 154B is not properly engaging the field.

It should be appreciated that the different positions of the sensor(s) 100A, 100B, 100C along the direction of travel 14 may be taken into account when comparing the data generated by the sensor(s) 100A, 100B, 100C.

Figure 7:
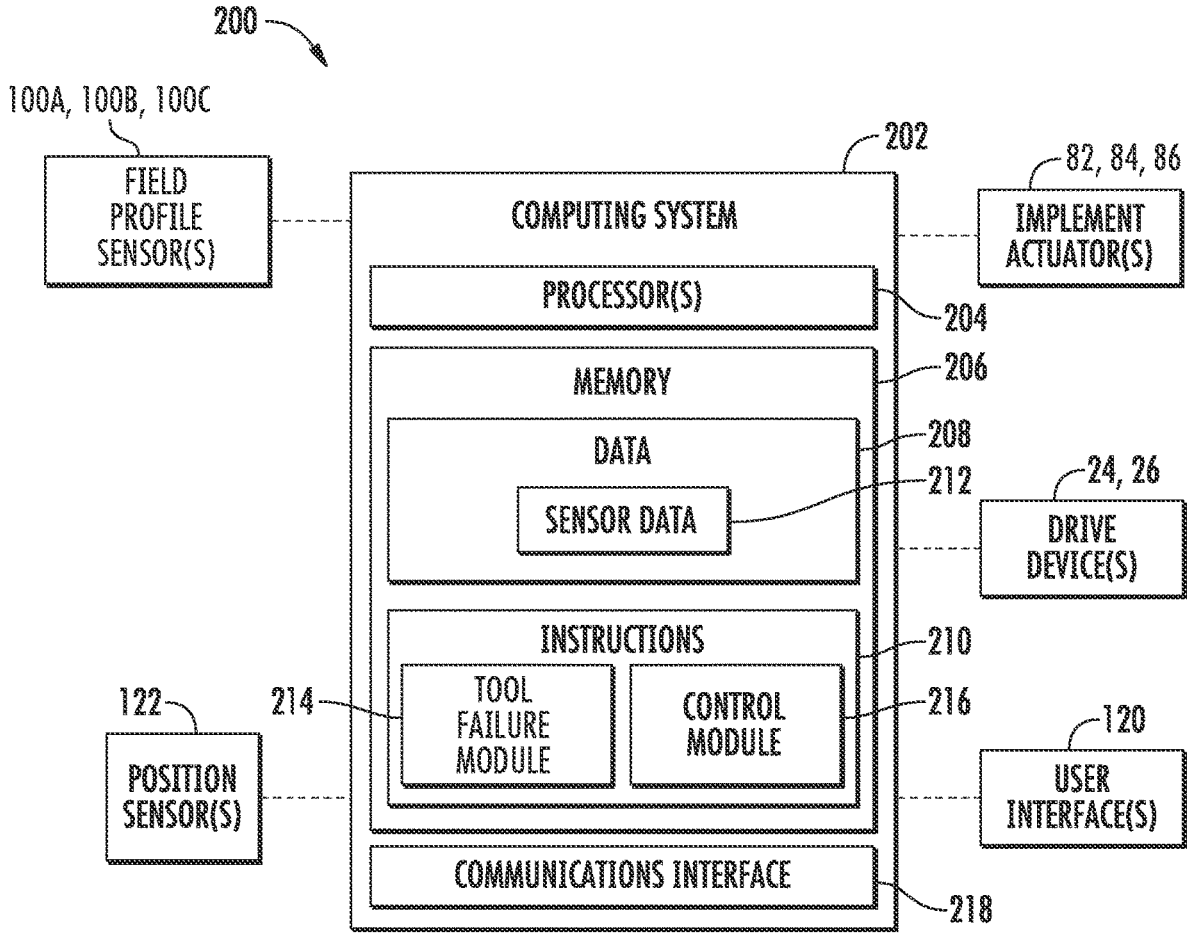
FIG. 7 illustrates a schematic view of an agricultural system for detecting failure of a ground-engaging tool of an agricultural implement in accordance with aspects of the present subject matter.

Turning now to FIG. 7, a schematic view is illustrated of one embodiment of an agricultural system 200 for detecting failure of a ground-engaging tool of an agricultural implement. In general, the system 200 will be described herein with reference to the implement 10 and vehicle 12 described above with reference to FIGS. 1 and 2, the shank 50 described above with reference to FIG. 3, and the example profiles described with reference to FIGS. 4-6. However, it should be appreciated that the disclosed system 200 may generally be utilized with any other suitable implement/vehicle combination having any other suitable implement/vehicle configuration and/or with shanks having any other suitable shank configuration. Additionally, it should be appreciated that, for purposes of illustration, communicative links or electrical couplings of the system 200 shown in FIG. 7 are indicated by dashed lines.

In several embodiments, the system 200 may include a computing system 202 and various other components configured to be communicatively coupled to and/or controlled by the computing system 202, such as the field profile sensor(s) 100A, 100B, 100C configured to generate data indicative of profile(s) (e.g., surface profile(s) 156, 156', 156", sub-surface profile(s) 158, 158', 158", and/or the like) of the field, actuator(s) of the implement 10 (e.g., implement actuator(s) 82, 84, 86), drive device(s) of the vehicle 12 (e.g., engine 24, transmission 26, etc.), and/or a user interface(s) (e.g., user interface(s) 120). The user interface(s) 120 described herein may include, without limitation, any combination of input and/or output devices that allow an operator to provide operator inputs to the computing system 202 and/or that allow the computing system 202 to provide feedback to the operator, such as a keyboard, keypad, pointing device, buttons, knobs, touch sensitive screen, mobile device, audio input device, audio output device, and/or the like. Additionally, the computing system 202 may be communicatively coupled to one or more position sensors 122 configured to generate data indicative of the location of the implement 10 and/or the vehicle 12, such as a satellite navigation positioning device (e.g., a GPS system, a Galileo positioning system, a Global Navigation satellite system (GLONASS), a BeiDou Satellite Navigation and Positioning system, a dead reckoning device, and/or the like).

In general, the computing system 202 may correspond to any suitable processor-based device(s), such as a computing device or any combination of computing devices. Thus, as shown in FIG. 7, the computing system 202 may generally include one or more processor(s) 204 and associated memory devices 206 configured to perform a variety of computer-implemented functions (e.g., performing the methods, steps, algorithms, calculations and the like disclosed herein). As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory 206 may generally comprise memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory 206 may generally be configured to store information accessible to the processor(s) 204, including data 208 that can be retrieved, manipulated, created and/or stored by the processor(s) 204 and instructions 210 that can be executed by the processor(s) 204.

It should be appreciated that the computing system 202 may correspond to an existing computing device for the implement 10 or the vehicle 12 or may correspond to a separate processing device. For instance, in one embodiment, the computing system 202 may form all or part of a separate plug-in module that may be installed in operative association with the implement 10 or the vehicle 12 to allow for the disclosed system and method to be implemented without requiring additional software to be uploaded onto existing control devices of the implement 10 or the vehicle 12.

In several embodiments, the data 208 may be stored in one or more databases. For example, the memory 206 may include a sensor database 212 for storing data generated by the sensors 100A, 100B, 100C, 122. For instance, each of the field profile sensor(s) 100A, 100B, 100C may be configured to continuously or periodically capture data associated with an aft portion of the field. Additionally, the data from the sensor(s) 100A, 100B, 100C may be taken with reference to the position of the implement 10 and/or the vehicle 12 within the field based on the position data from the position sensor(s) 122. The data transmitted to the computing system 202 from the sensor(s) 100A, 100B, 100C, 122 may be stored within the sensor database 212 for subsequent processing and/or analysis. It should be appreciated that, as used herein, the term "sensor data 212" may include any suitable type of data received from the sensor(s) 100A, 100B, 100C, 122 that allows for the field profile(s) to be accurately analyzed including image data, point-cloud data, radar data, ultrasound data, EMI data, GPR data, GPS coordinates, and/or other suitable type of data.

The instructions 210 stored within the memory 206 of the computing system 202 may be executed by the processor(s) 204 to implement a tool failure module 214. In general, the tool failure module 214 may be configured to assess the sensor data 212 deriving from the sensor(s) 100A, 100B, 100C, 122 to determine field profile(s) (e.g., surface profile(s), sub-surface profile(s), etc.) of the field. For instance, as indicated above, the field profile data generated by the field profile sensor(s) 100A, 100B, 100C may be indicative of the field surface profile of the surface of the field and/or the field sub-surface profile below the surface of the field, which in turn, is indicative of whether tools (e.g., shanks 50, leveling disks 52, and/or the like) of the implement 10 have failed. For example, the tool failure module 214 may compare the profile(s) of the aft portion(s) of the field determined from the data 212 generated by the field profile sensor(s) 100A, 100B, 100C to a baseline profile(s) of the field to determine if the ground engaging tool(s) (e.g., shank(s) 50, leveling disk(s) 52, and/or the like) has failed. More particularly, the tool failure module 214 may compare a lane profile associated with a lane (e.g., lane(s) 154A, 154B, 154C, 154D) worked by the ground engaging tool (e.g., shank(s) 50, leveling disk(s) 52, and/or the like) to a baseline profile of the field.

For instance, the baseline profile of the field may be an expected lane profile expected to have been created by an associated ground engaging tool. If a dimension or shape of a feature associated with the lane profile differs from a dimension or shape of a corresponding feature associated with the expected lane profile, the tool failure module 214 may determine that the ground engaging tool(s) corresponding to the particular lane(s) has failed. In some embodiments, the tool failure module 214 may determine that the ground engaging tool(s) corresponding to the lane(s) has failed only when the dimension or shape of the feature associated with the lane profile differs from the dimension or shape of the corresponding feature associated with the expected lane profile for a given time and/or distance along the direction of travel 14 of the implement 10.

When the data 212 generated by the sensor(s) 100B is indicative of a surface profile of the portion of the field aft of the shank(s) 50, the tool failure module 214 may compare the surface profile to an expected surface profile expected to be created after the shanks 50 have worked the field to a prescribed or desired depth to determine if one or more of the shanks 50 has failed. For instance, the tool failure module 214 may compare the surface profile (e.g., surface profile 156' in FIG. 5) to an expected surface profile to be created after the shanks 50 have worked the field to a prescribed or desired depth (e.g., depth D2 in FIG. 5) to determine if one or more of the shanks 50 has failed. For example, the tool failure module 214 may compare each of the surface profiles within the lanes (e.g., lanes 154A, 154B, 154C, 154D in FIG. 5) of the surface profile (e.g., surface profile 156' in FIG. 5) to an expected lane profile of the expected surface profile to be created after each of the shanks 50 have worked the field to a prescribed or desired depth (e.g., depth D2) to determine if one or more of the shanks 50 has failed. It should be appreciated that the expected lane profile may be an average lane profile determined from the surface profiles within the lanes (e.g., lanes 154A, 154B, 154C, 154D in FIG. 5), a predetermined lane surface profile such as a lane surface profile confirmed to have been generated when the shank(s) 50 have not failed, a theoretical or calculated lane profile expected to be generated based on the geometry of the shank(s) 50 and the operating settings of the implement (e.g., the operating depth (e.g., depth D2), traveling speed, etc.), and/or the like.

In such embodiment, if the surface profile within one or more of the lanes (e.g., lanes 154A, 154B, 154C, 154D in FIG. 5) does not have one or more features having a given shape (e.g., trench, mound(s), etc.) of the expected lane surface profile, and/or if dimensions of the features of the surface profile within one or more of the lanes (e.g., lanes 154A, 154B, 154C, 154D in FIG. 5) differs from dimensions associated with the corresponding features of the expected lane surface profile, then the tool failure module 214 may determine that the shank(s) 50 associated with those lane(s) (e.g., lanes 154A, 154B, 154C, 154D in FIG. 5) has failed. For instance, as discussed above, the surface profile 160B within the second lane 154B in FIG. 5 is missing or without a trench and associated mounds. As such, the tool failure module 214 determines that the shape, and thus, the dimensions, of the lane surface profile associated with the second lane 154B differ from the expected shape and dimensions of the expected lane surface profile. Accordingly, the tool failure module 214 determines that the shank 50 associated with the second lane 154B may have failed (e.g., that the shear bolt associated with the shank 50 has broken). The shape of the surface profiles 160A, 160C, 160D within the first, third, and fourth lanes 154A, 154C, 154D in FIG. 5 each have a trench 161A, 161C, 161D and associated mounds 162, 163, where the dimensions of the trenches 161A, 161C, 161D (e.g., the width W1 and the depth D2) are within tolerance of expected dimensions (e.g., an expected width and an expected depth), and the dimension of the mounds 162, 163 (e.g., height H1) is within a tolerance of an expected dimension (e.g., an expected height). Therefore, the tool failure module 214 determines that the shanks 50 associated with the first, third, and fourth lanes 154A, 154C, 154D have not failed.

Similarly, when the data 212 generated by the sensor(s) 100B is indicative of a sub-surface profile of the portion of the field aft of the shank(s) 50, the tool failure module 214 may compare the sub-surface profile to an expected sub-surface profile to be created after the shanks 50 have worked the field to a prescribed or desired depth to determine if one or more of the shanks 50 has failed. For instance, the tool failure module 214 may compare the sub-surface profile (e.g., sub-surface profile 158' in FIG. 5) to an expected sub-surface profile to be created after the shanks 50 have worked the field to a prescribed or desired depth (e.g., depth D2) to determine if one or more of the shanks 50 has failed. For example, the tool failure module 214 may compare each of the sub-surface profiles within the lanes (e.g., lanes 154A, 154B, 154C, 154D in FIG. 5) of the sub-surface profile (e.g., sub-surface profile 158' in FIG. 5) to an expected lane profile of the expected sub-surface profile to be created after each of the shanks 50 have worked the field to a prescribed or desired depth (e.g., depth D2) to determine if one or more of the shanks 50 has failed. It should be appreciated that the expected lane profile may be an average lane profile determined from the sub-surface profiles within the lanes (e.g., lanes 154A, 154B, 154C, 154D in FIG. 5), a predetermined lane sub-surface profile such as a lane sub-surface profile confirmed to have been generated when the shank(s) 50 have not failed, a theoretical or calculated lane sub-surface profile (e.g., a level sub-surface profile at depth D3) expected to be generated based on the geometry of the shank(s) 50 and the operating settings of the implement (e.g., the operating depth (e.g., depth D2), traveling speed, etc.), and/or the like.

In such embodiment, if the features of the sub-surface profile within one or more of the lanes (e.g., lanes 154A, 154B, 154C, 154D in FIG. 5) has shapes that are not present in the expected lane surface profile, and/or if dimensions or shapes of the sub-surface profile within one or more of the lanes (e.g., lanes 154A, 154B, 154C, 154D in FIG. 5) differs from dimensions associated with the corresponding features of the expected lane sub-surface profile, then the tool failure module 214 may determine that the shank(s) 50 associated with the lane(s) (e.g., lane(s) 154A, 154B, 154C, 154D in FIG. 5) has failed. For instance, as discussed above, the portion 158'A of the sub-surface profile 158' within the second lane 154B in FIG. 5 has a plateau in the compaction layer at a depth D1 below the surface of the field, where the depth D1 is above an expected sub-surface at depth D3. As such, the tool failure module 214 determines that the shape and the dimensions of the portion 158'A of the sub-surface profile 158' associated with the second lane 154B differ from the expected shape (e.g., planar, without a plateau) and dimensions (e.g., depth D3) of the expected lane sub-surface profile. Therefore, the tool failure module 214 determines that the shank 50 associated with the second lane 154B may have failed (e.g., that the shear bolt associated with the shank 50 has broken). The portions of the sub-surface profile 158' within the first, third, and fourth lanes 154A, 154C, 154D in FIG. 5 are all substantially flat and extend at the depth D3, which matches, or substantially matches within a tolerance, the expected shape (e.g., planar) and dimension (e.g., depth D3) of an expected sub-profile. Accordingly, the tool failure module 214 determines that the shanks 50 associated with the first, third, and fourth lanes 154A, 154C, 154D have not failed.

When the data 212 generated by the sensor(s) 100C is indicative of a surface profile of the portion of the field aft of the leveling disk(s) 52, the tool failure module 214 may compare the surface profile to an expected surface profile to be created after the leveling disks 52 have worked the field to determine if one or more of the leveling disks 52 has failed. For instance, the tool failure module 214 may compare the surface profile (e.g., surface profile 156" in FIG. 6) to an expected surface profile to be created after the leveling disks 52 have worked the field to determine if one or more of the leveling disks 52 has failed. For example, the tool failure module 214 may compare the surface profile within each of the lanes (e.g., lane(s) 154A, 154B, 154C, 154D in FIG. 6) of the surface profile (e.g., surface profile 156" in FIG. 6) to an expected lane profile of the expected surface profile to be created after each of the leveling disks 52 have worked the field to determine if one or more of the leveling disks 52 has failed. Again, it should be appreciated that the expected lane profile may be an average lane profile determined from the surface profiles within the lanes (e.g., lanes 154A, 154B, 154C, 154D in FIG. 6), a predetermined lane surface profile such as a lane surface profile confirmed to have been generated when the leveling disk(s) 52 have not failed, a theoretical or calculated lane surface profile expected to be generated based on the geometry of the leveling disks 52 and the operating settings of the implement (e.g., traveling speed, etc.), and/or the like.

In such embodiment, if the surface profile within one or more of the lanes (e.g., lane(s) 154A, 154B, 154C, 154D in FIG. 6) has one or more features that does not match the expected level, lane surface profile, and/or if dimensions or shapes of the surface profile within one or more of the lanes (e.g., lane(s) 154A, 154B, 154C, 154D in FIG. 6) differs from dimensions or shapes associated with the corresponding features of the expected lane surface profile, then the tool failure module 214 may determine that the leveling disk(s) 52 associated with the respective lane(s) (e.g., lane(s) 154A, 154B, 154C, 154D in FIG. 6) has failed. For instance, as discussed above, the surface profile 160C' within the third lane 154C in FIG. 6 has a trench 161C' corresponding to a portion of the v-shaped trench 161C from FIG. 5 and retains the mound 162. As such, the tool failure module 214 determines that the shape (e.g., trench 161C' and mound 162) and the dimensions of the lane surface profile (e.g., depth of trench 161C' and height H1 of mound 162) associated with the third lane 154C differ from the expected shape (e.g., planar) and dimensions (e.g., essentially no height or depth) of the expected lane surface profile (e.g., a substantially planar surface profile, generally smoother than after the disk blades 46). Thus, the tool failure module 214 determines that one of the leveling disks 52 associated with the third lane 154C may be missing. The shape of the surface profiles 160A, 160B, 160D within the first, second, and fourth lanes 154A, 154B, 154D in FIG. 6 are each substantially planar and thus, match expected shape and dimensions of an expected lane profile within tolerances. As such, the tool failure module 214 determines that the leveling disks 52 associated with the first, second, and fourth lanes 154A, 154B, 154D are not missing.

Similarly, when the data 212 is indicative of a sub-surface profile of the portion of the field aft of the leveling disks 52, the tool failure module 214 may compare the sub-surface profile to an expected sub-surface profile to be created after the leveling disks 52 have worked the field to determine if one or more of the shanks 50 has failed. For instance, the tool failure module 214 may compare the sub-surface profile (e.g., sub-surface profile 158" in FIG. 6) to an expected sub-surface profile to be created after the leveling disks 52 have worked the field to determine if one or more of the shanks 50 has failed. For example, the tool failure module 214 may compare each of the sub-surface profiles within the lanes (e.g., lane(s) 154A, 154B, 154C, 154D in FIG. 6) of the sub-surface profile (e.g., sub-surface profile 158" in FIG. 6) to an expected lane profile of the expected sub-surface profile to be created after the leveling disks 52 have worked the field to determine if one or more of the shanks 50 has failed. It should again be appreciated that the expected lane profile may be an average lane profile determined from the sub-surface profiles within the lanes (e.g., lanes 154A, 154B, 154C, 154D in FIG. 6), a predetermined lane sub-surface profile such as a lane sub-surface profile confirmed to have been generated when the shank(s) 50 have not failed, a theoretical or calculated lane sub-surface profile (e.g., a level sub-surface at depth D3) expected to be generated based on the geometry of the shank(s) 50 and the operating settings of the implement (e.g., the operating depth (e.g., depth D2), traveling speed, etc.), and/or the like.

In such embodiment, if the sub-surface profile within one or more of the lanes (e.g., lane(s) 154A, 154B, 154C, 154D in FIG. 6) has features that are not present in the expected lane surface profile, and/or if dimensions or shapes of the sub-surface profile within one or more of the lanes (e.g., lane(s) 154A, 154B, 154C, 154D in FIG. 6) differs from dimensions associated with the corresponding features of the expected lane sub-surface profile, then the tool failure module 214 may determine that the shank(s) 50 associated with the lane(s) (e.g., lane(s) 154A, 154B, 154C, 154D in FIG. 6) has failed. For instance, as discussed above, the portion 158"A of the sub-surface profile 158" within the second lane 154B in FIG. 6 has a plateau at the depth D1, which is above an expected sub-surface at depth D3. As such, the tool failure module 214 determines that the shape (e.g., plateau) and the dimensions (e.g., depth D1) of the portion 158'A of the sub-surface profile 158" associated with the second lane 154B differ from the expected shape (e.g., planar) and dimensions (e.g., depth D3) of the expected lane sub-surface profile. Therefore, the tool failure module 214 determines that the shank 50 associated with the second lane 154B may have failed (e.g., that the shear bolt associated with the shank 50 has broken). The shape of the portions of the sub-surface profile 158" within the first, third, and fourth lanes 154A, 154C, 154D in FIG. 6 are all substantially flat and extend at the depth D3, which matches, within tolerance, the expected depth of an expected sub-profile. As such, the tool failure module 214 determines that the shanks 50 associated with the first, third, and fourth lanes 154A, 154C, 154D have not failed.

Again, once a ground-engaging tool (e.g., shank(s) 50, leveling disk(s) 52, etc.) is determined to have potentially failed, the tool failure module 214 may continue monitoring the potentially failed ground-engaging tool to confirm whether the ground-engaging tool has actually failed. For instance, if the tool failure module 214 determines that the potentially failed ground-engaging tool creates a lane profile (e.g., a surface lane profile, a sub-surface lane profile, etc.) that differs from an expected lane profile (e.g., an expected surface lane profile, an expected sub-surface lane profile, etc.) for at least a predetermined or given time or predetermined or given distance along the direction of travel 14 of the implement 10, the tool failure module 214 determines that the potentially failed ground-engaging tool has actually failed.

Further, as indicated above, the tool failure module 214 may compare the data from multiple sensors 100A, 100B, 100C to confirm when a tool has failed. For instance, the tool failure module 214 may determine from the data generated by the first sensor(s) 100A, whether the profile (e.g., the surface profile 156 and/or sub-surface profile 158 in FIG. 4) of the portion of the field aft of the disk blades 46 is substantially level, such that the shanks 50 should subsequently create an expected profile (e.g., an expected surface profile and/or an expected sub-surface profile). Similarly, whether the profile (e.g., the surface profile 156' and/or sub-surface profile 158' in FIG. 5) of the portion of the field aft of the shanks 50 is as expected, such that the leveling disks 52 should subsequently create an expected profile (e.g., an expected surface profile and/or an expected sub-surface profile).

It should be appreciated that the tool failure module 214 may use any known correlation (e.g., look-up tables, suitable mathematical formulas, and/or algorithms) between the data 212 generated by the sensor(s) 100A, 100B, 100C and expected field profiles to determine whether tools (e.g., shanks 50, leveling disks 52, and/or the like) of the implement 10 have failed. Such known correlations may also be stored within the memory 206, or otherwise be accessible to the tool failure module 214. In some embodiments, the tool failure module 214 may also generate a field map based at least in part on the data 212 generated by the field profile sensor(s) 100A, 100B, 100C that indicates the location in the field where ground engaging tool(s) have failed. It should additionally be appreciated that, in some embodiments, the tool failure module 214 may also be configured to control the sensor(s) 100A, 100B, 100C, 122 to generate data.

Additionally, in some embodiments, the control module 216 may be configured to perform a control action based at least in part on the monitored field profiles. For instance, the control action, in one embodiment, includes adjusting the operation of one or more of the drive device(s) 24, 26 to adjust a speed of (e.g., slow down or stop) the implement 10 and/or the vehicle 12 when it is determined that one or more of the ground engaging tools has failed based on the monitored field profiles. In some embodiments, the control action may include controlling the operation of the user interface 120 to notify an operator of the field profiles, failed ground-engaging tools (e.g., broken shear bolt of shank(s) 50, missing leveling disk(s) 52), and/or the like. Moreover, in some embodiments, the control action may include adjusting the operation of the implement 10 based on an input from an operator, e.g., via the user interface 120 in response to a notification that a ground-engaging tool(s) has failed. Additionally, in one embodiment, the computing system 202 may control an operation of the implement actuator(s) 82, 84, 86 to adjust one or more operating settings of the implement tools. For instance, if the computing system 202 determines that the shanks 50 are not operating at the correct depth, but have not failed, the computing system 202 may control an operation of the actuator(s) 84 to adjust the penetration depth of the shanks 50. Similarly, if the computing system 202 determines that the leveling disks 52 are not leveling the field properly, but have not failed, the computing system 202 may control an operation of the actuator(s) 86 to adjust the aggressiveness of the leveling disks 52 (e.g., by adjusting the down pressure on the basket assemblies 54).

Additionally, as shown in FIG. 7, the computing system 202 may also include a communications interface 218 to provide a means for the computing system 202 to communicate with any of the various other system components described herein. For instance, one or more communicative links or interfaces (e.g., one or more data buses) may be provided between the communications interface 218 and the sensor(s) 100A, 100B, 100C, 122 to allow data transmitted from the sensor(s) 100A, 100B, 100C, 122 to be received by the computing system 202. Similarly, one or more communicative links or interfaces (e.g., one or more data buses) may be provided between the communications interface 218 and the user interface 120 to allow operator inputs to be received by the computing system 202 and to allow the computing system 202 to control the operation of one or more components of the user interface 120. Moreover, one or more communicative links or interfaces (e.g., one or more data buses) may be provided between the communications interface 218 and the actuator(s) 82, 84, 86 and/or the drive device(s) 24, 26 to allow the computing system 202 to control the operation of one or more components of the actuator(s) 82, 84, 86 and/or the drive device(s) 24, 26.

Figure 8:
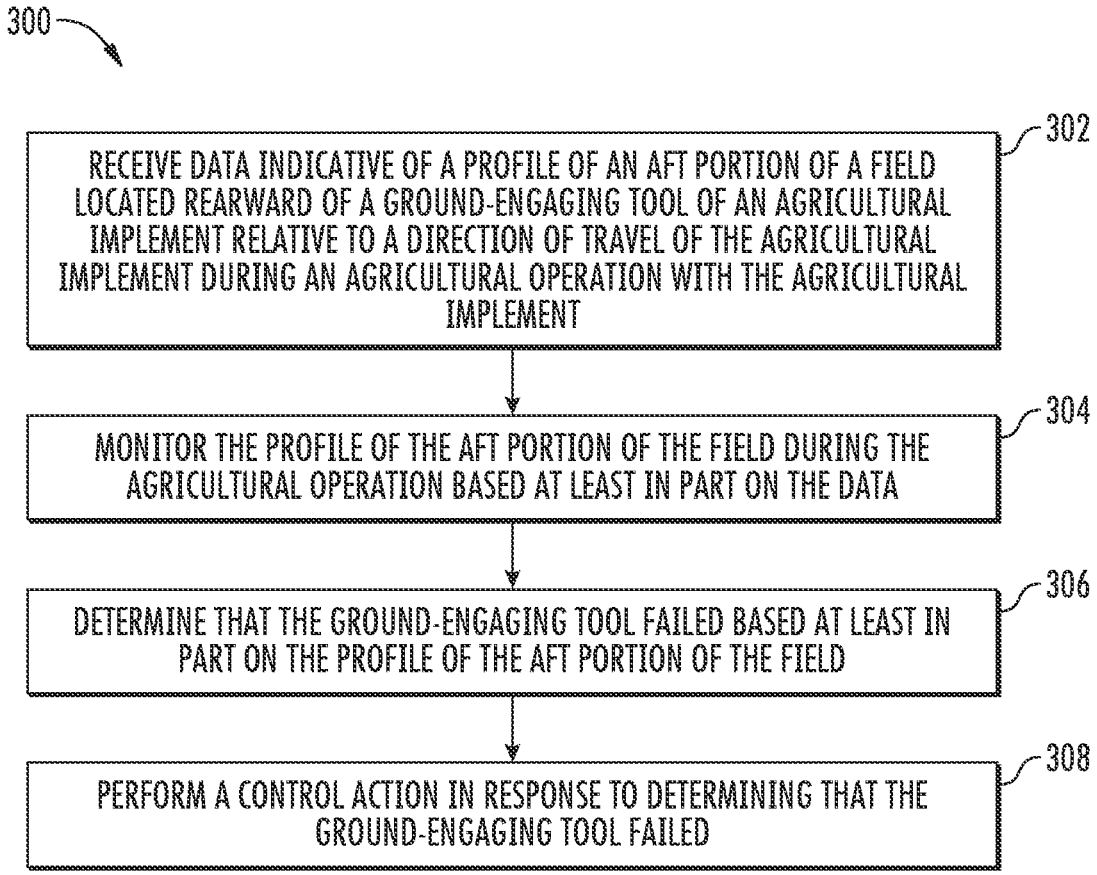
FIG. 8 illustrates a flow diagram of one embodiment of a method for detecting failure of a ground-engaging tool of an agricultural implement in accordance with aspects of the present subject matter.

Referring now to FIG. 8, a flow diagram of one embodiment of a method 300 for detecting failure of a ground-engaging tool of an agricultural implement is illustrated in accordance with aspects of the present subject matter. In general, the method 300 will be described herein with reference to the implement 10 and the work vehicle 12 shown in FIGS. 1-2, the shank 50 described above with reference to FIG. 3, the example profiles described with reference to FIGS. 4-6, as well as the various system components shown in FIG. 7. However, it should be appreciated that the disclosed method 300 may be implemented with work vehicles and/or implements having any other suitable configurations, and/or within systems having any other suitable system configurations. In addition, although FIG. 8 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 8, at (302), the method 300 may include receiving data indicative of a profile of an aft portion of a field located rearward of a ground-engaging tool of an agricultural implement relative to a direction of travel of the agricultural implement during an agricultural operation with the agricultural implement. For instance, as described above, the computing system 202 may be configured to receive data 212 indicative of a profile (e.g., a surface profile and/or a sub-surface profile) of an aft portion(s) of a field located rearward of a ground-engaging tool (e.g., a shank 50 and/or a leveling disk 52) of the agricultural implement 10 relative to the direction of travel 14 of the agricultural implement during an agricultural operation with the agricultural implement 10.

At (304), the method 300 may include monitoring the profile of the aft portion of the field during the agricultural operation based at least in part on the data. For example, as discussed above, the computing system 202 may monitor the profile (e.g., the surface profile and/or the sub-surface profile) of the aft portion(s) of the field during the agricultural operation based at least in part on the data 212.

Moreover, at (306), the method 300 may include determining that the ground-engaging tool failed based at least in part on the profile of the aft portion of the field. For instance, as discussed above, the computing system 202 may determine that the ground-engaging tool (e.g., the shank 50 and/or the leveling disk 52) failed based at least in part on the profile (e.g., the surface profile and/or the sub-surface profile) of the aft portion(s) of the field. For example, if the profile of the aft portion(s) of the field associated with the ground-engaging tool differs from an expected profile for the respective aft portion(s) of the field, the computing system 202 may determine that the ground-engaging tool failed.

Additionally, at (308), the method 300 may include performing a control action in response to determining that the ground-engaging tool failed. For instance, as indicated above, the computing system 202 may perform a control action in response to determining that the ground-engaging tool (e.g., the shank 50 and/or the leveling disk 52) failed. For example, when the computing system 202 has determined that the ground-engaging tool (e.g., the shank 50 and/or the leveling disk 52) failed, the computing system 202 may control an operation of the user interface 220 to indicate that the ground-engaging tool (e.g., the shank 50 and/or the leveling disk 52) failed, control an operation of the drive device(s) 24, 26 to slow down or stop the implement 10 and the vehicle 12, and/or the like.

It is to be understood that the steps of the method 300 are performed by the computing system 200 upon loading and executing software code or instructions which are tangibly stored on a tangible computer readable medium, such as on a magnetic medium, e.g., a computer hard drive, an optical medium, e.g., an optical disk, solid-state memory, e.g., flash memory, or other storage media known in the art. Thus, any of the functionality performed by the computing system 200 described herein, such as the method 300, is implemented in software code or instructions which are tangibly stored on a tangible computer readable medium. The computing system 200 loads the software code or instructions via a direct interface with the computer readable medium or via a wired and/or wireless network. Upon loading and executing such software code or instructions by the computing system 200, the computing system 200 may perform any of the functionality of the computing system 200 described herein, including any steps of the method 300 described herein.

The term "software code" or "code" used herein refers to any instructions or set of instructions that influence the operation of a computer or computing system. They may exist in a computer-executable form, such as machine code, which is the set of instructions and data directly executed by a computer's central processing unit or by a computing system, a human-understandable form, such as source code, which may be compiled in order to be executed by a computer's central processing unit or by a computing system, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit or by a computing system.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An agricultural system for detecting failure of a ground-engaging tool of an agricultural implement, the agricultural system comprising:

a ground-engaging tool supported on an agricultural implement, the ground-engaging tool being configured to engage a field during an agricultural operation of the agricultural implement within the field;

a field profile sensor configured to generate data indicative of a profile of an aft portion of the field located rearward of the ground-engaging tool relative to a direction of travel of the agricultural implement; and a computing system communicatively coupled to the field profile sensor, the computing system being configured to monitor the profile of the aft portion of the field during the agricultural operation based at least in part on the data generated by the field profile sensor and determine that the ground-engaging tool failed based at least in part on the profile of the field.

2. The agricultural system of claim 1, wherein the computing system is configured to determine that the ground-engaging tool failed by comparing the profile of the aft portion of the field to a baseline profile of the field.

3. The agricultural system of claim 2, wherein the profile of the aft portion of the field comprises a lane profile associated with a lane of the field worked by the ground-engaging tool, wherein the baseline profile comprises an expected lane profile associated with the ground-engaging tool, and wherein the computing system is configured to determine that the ground-engaging tool failed by comparing the lane profile to the expected lane profile associated with the ground-engaging tool.

4. The agricultural system of claim 3, wherein the computing system is configured to determine that the ground-engaging tool failed when a dimension or shape of a feature associated with the lane profile differs from a dimension or shape of a corresponding feature associated with the expected lane profile.

5. The agricultural system of claim 4, wherein the computing system is configured to determine that the ground-engaging tool failed when the dimension or shape of the feature associated with the lane profile differs from the dimension or shape of the corresponding feature associated with the expected lane profile for at least a given distance along the direction of travel of the agricultural implement.

6. The agricultural system of claim 1, wherein the profile of the aft portion of the field comprises a sub-surface profile, the sub-surface profile being a profile of a compaction layer beneath a surface of the aft portion of the field.

7. The agricultural system of claim 6, further comprising:

an attachment structure, the ground-engaging tool being supported on the agricultural implement by the attachment structure, the ground-engaging tool being pivotably coupled to the attachment structure at a pivot joint; and a shear pin at least partially extending through the attachment structure and the ground-engaging tool to prevent pivoting of the ground-engaging tool about the pivot joint, the ground-engaging tool pivoting relative to the attachment structure and out of engagement with the field when the shear pin fails, wherein the computing system is configured to determine that the ground-engaging tool failed by determining that the shear pin has failed based at least in part on the sub-surface profile.

8. The agricultural system of claim 1, wherein the profile of the aft portion of the field comprises a surface profile of a surface of the aft portion of the field.

9. The agricultural system of claim 8, wherein the ground-engaging tool comprises a leveling disk positioned aft of a shank relative to the direction of travel of the agricultural implement, and wherein the computing system is configured to determine that the ground-engaging tool failed by determining that the leveling disk is missing based at least in part on the surface profile.

10. The agricultural system of claim 1, wherein the field profile sensor comprises at least one of an ultrasonic sensor, a lidar sensor, a radar sensor, an electromagnetic induction sensor, or a ground-penetrating radar sensor.

11. An agricultural method for detecting failure of a ground-engaging tool of an agricultural implement, the ground-engaging tool being supported on the agricultural implement, the ground-engaging tool being configured to engage a field during an agricultural operation of the agricultural implement within the field, the agricultural method comprising:

receiving, with a computing system, data indicative of a profile of an aft portion of the field located rearward of the ground-engaging tool relative to a direction of travel of the agricultural implement, the data being generated by a field profile sensor;

monitoring, with the computing system, the profile of the aft portion of the field during the agricultural operation based at least in part on the data generated by the field profile sensor;

determining, with the computing system, that the ground-engaging tool failed based at least in part on the profile of the aft portion of the field; and performing, with the computing system, a control action in response to determining that the ground-engaging tool failed.

12. The agricultural method of claim 11, wherein determining that the ground-engaging tool failed comprises determining that the ground-engaging tool failed by comparing the profile of the aft portion of the field to a baseline profile of the field.

13. The agricultural method of claim 12, wherein the profile of the aft portion of the field comprises a lane profile associated with a lane of the field worked by the ground-engaging tool, wherein the baseline profile comprises an expected lane profile associated with the ground-engaging tool, and wherein comparing the profile of the aft portion of the field to a baseline profile of the field comprises comparing the lane profile to the expected lane profile associated with the ground-engaging tool.

14. The agricultural method of claim 13, wherein determining that the ground-engaging tool failed comprises determining that the ground-engaging tool failed when a dimension or shape of a feature associated with the lane profile differs from a dimension or shape of a corresponding feature associated with the expected lane profile.

15. The agricultural method of claim 14, wherein determining that the ground-engaging tool failed comprises determining that the ground-engaging tool failed when the dimension or shape of the feature associated with the lane profile differs from the dimension or shape of the corresponding feature associated with the expected lane profile for at least a given distance along the direction of travel of the agricultural implement.

16. The agricultural method of claim 11, wherein the profile of the aft portion of the field is a sub-surface profile, the sub-surface profile being a profile of a compaction layer beneath a surface of the aft portion of the field.

17. The agricultural method of claim 16, wherein the ground-engaging tool is supported on the agricultural implement by an attachment structure, the ground-engaging tool being pivotably coupled to the attachment structure at a pivot joint, a shear pin at least partially extending through the attachment structure and the ground-engaging tool to prevent pivoting of the ground-engaging tool about the pivot joint, the ground-engaging tool pivoting relative to the attachment structure and out of engagement with the field when the shear pin fails, wherein determining that the ground-engaging tool failed comprises determining that the shear pin has failed based at least in part on the sub-surface profile.

18. The agricultural method of claim 11, wherein the profile of the aft portion of the field is a surface profile of a surface of the aft portion of the field.

19. The agricultural method of claim 18, wherein the ground-engaging tool comprises a leveling disk positioned aft of a shank relative to the direction of travel of the agricultural implement, and wherein determining that the ground-engaging tool failed comprises determining that the leveling disk is missing based at least in part on the surface profile.

20. The agricultural method of claim 11, wherein the field profile sensor comprises at least one of an ultrasonic sensor, a lidar sensor, a radar sensor, an electromagnetic induction sensor, or a ground-penetrating radar sensor.

* * * * *